US006006842A

United States Patent [19]

Stilwell et al.

[11] Patent Number: 6,006,842

[45] Date of Patent: Dec. 28, 1999

[54] NON-FRAGMENTING, NON-EXPLOSIVE ACTUATING VALVE MECHANISM FOR FIRE SUPPRESSION APPARATUS

[75] Inventors: Bradford T. Stilwell, Blue Springs; Bon F. Shaw, Independence, both of Mo.; William M. Howerton, Spring, Tex.

[73] Assignee: Fike Corporation, Blue Springs, Mich.

[21] Appl. No.: 09/126,501

[22] Filed: Jul. 30, 1998

[51] Int. Cl.[6] ..... A62C 37/11

[52] U.S. Cl. ..... 169/60; 169/26; 222/54; 222/399

[58] Field of Search ..... 169/58, 56, 54, 169/51, 5, 19, 26, DIG. 2, 60, 61, 66, 69; 222/399, 54, 541.6, 541.1; 239/309

[56] References Cited

U.S. PATENT DOCUMENTS 4,126,184 11/1978 Hinrichs ..... 169/66
5,069,291 12/1991 O'Connell ..... 169/66

*Primary Examiner*—Andres Kashnikow
*Assistant Examiner*—Sean P. O'Hanlon
*Attorney, Agent, or Firm*—Hovey, Williams, Timmons & Collins

[57] ABSTRACT

Hazard suppression apparatus (10) is provided with a container (12) of suppression fluid and a non-explosive, pressurized gas-operated actuator assembly (16). The assembly (16) includes an actuator body (32) and first and second spaced apart rupture discs (36, 38) defining a zone (43) therebetween; the first disc (36) is preferably of bulged, scored configuration, whereas the second disc (38) is flat and has a series of vent openings (52) therethrough. A perforate, bar-type support (34) is positioned adjacent the second disc (38) and remote from the zone (43). A container (18) of high pressure actuating fluid is operatively coupled to the body (32) via a coupling unit (56) having an elongated, tubular nipple (58) equipped with a third rupture disc (62). A valve (70), adapted for connection with a hazard sensor is interposed between the container (18) and the coupling unit (56). In use, when a hazard is detected the solenoid valve (70) opens and a charge of high pressure actuating gas is delivered to the interdisc zone (43) by rupture of the third disc (62). This causes rapid rupture of the first disc (36) while the support (34) prevents premature opening of the second disc (36). After the first disc (36) ruptures, the pressure differential across second disc (38) causes it to rupture, thereby venting the contents of container (12) to the protected area.

16 Claims, 3 Drawing Sheets

NON-FRAGMENTING, NON-EXPLOSIVE ACTUATING VALVE MECHANISM FOR FIRE SUPPRESSION APPARATUS

BACKGROUND OF THE INVENTION

1. Field of the Invention

The present invention is broadly concerned with improved non-explosive actuator assemblies forming a part of hazard suppression apparatus, and complete suppression apparatus of this type. More particularly, the invention pertains to such actuator assemblies including first and second spaced apart rupture discs operable, upon delivery of a charge of high pressure initiator fluid to the zone therebetween, to sequentially rupture and permit full venting of hazard suppression fluid from a container thereof; a perforate support is provided adjacent the face of the second disc remote from the zone in order to prevent premature rupturing of the second disc and assure reliable operation.

2. Description of the Prior Art

Fire or explosion suppression systems typically include a container having a pressurized suppressant which is discharged into a protected area through a nozzle or outlet upon opening of a valve or opening a rupture disc. In the case of rupture discs, opening occurs when the pressure differential across the disc reaches a predetermined amount, known as the set or burst pressure. In a typical application, the pressure on one side of the disc is atmospheric and the set or burst pressure is on the order of 600–700 psig. Selection of material making up the rupture disc, as well as material thickness and disc modifications (e.g., bulging and/or lines of weakness) all influence the burst pressure.

It is also known to provide multiple disc actuator assemblies which are operatively coupled to a source of hazard suppression fluid. In one such design, a pair of spaced apart discs are provided, with the inner disc being perforated so that the zone between the discs is maintained at the same pressure as the fluid container. In order to rupture an assembly of this type, an electrically operated squib or initiator is placed through the sidewall of the actuator between the discs. This squib is provided with a side rupture disc in communication with the zone between the primary discs. In use, when a hazard is detected an electrical signal is sent to the squib which explosively ruptures the side-mounted disc. This in turn causes the imperforate outer disc to rupture, followed by rupturing of the inner perforated disc, i.e., the perforated disc is designed to withstand the pressure pulse generated by the squib long enough to allow burst of the outer imperforate disc.

In some applications however, electrically operated squibs or initiators are discouraged or even prohibited. For example, on oil rigs use of such squibs is considered a safety hazard, owing to the possibility of creating a large-scale explosion upon electrical actuation of the squib. It has been suggested to use other types of actuating mechanism in such cases, such as a source of high pressure inert gas, usually nitrogen. In systems of this type a solenoid valve is opened in response to sensing of a hazard, allowing the high pressure charge to rupture the side disc. However, it has been found that the pressure pulse generated by an inert gas charge differs considerably from that generated by a squib, and that as a consequence the prior multiple disc assemblies will not operate properly. Specifically, the perforate inner disc tends to initially burst causing the high pressure to be diffused into the contents of the fire suppression fluid container, with the result that the total system pressure is not sufficient to burst the outer imperforate. In short, the system fails.

There is accordingly a need in the art for improved pressurized fluid-operated hazard suppression apparatus, and particularly a fluid-type actuator assembly therefor, which assures that the discs of a multiple-disc actuator operate in the proper sequential order so as to assure rapid and reliable delivery of the suppression fluid to a protected area.

SUMMARY OF THE INVENTION

The present invention overcomes the problems outlined above and provides an actuator assembly adapted for connection to a container of pressurized hazard suppressant fluid having a venting outlet, in order to permit rapid selective opening of the container, thus permitting venting of the fluid from the outlet. Broadly speaking, the actuator assembly of the invention includes an actuator body presenting a passageway therethrough which is adapted for connection and communication with the suppression fluid container outlet. A pair of spaced apart first and second rupture discs are located across the passageway adjacent the body and define an enclosed zone therebetween. The first or outer disc is imperforate and normally seals the passageway, whereas the second disc is located adjacent the venting outlet and includes at least one (and preferably multiple) opening(s) therethrough for establishing communication between the container and interdisc zone, i.e., there is normally no pressure differential across the second disc. A perforate support is located adjacent the inner face of the second disc remote from the zone between the discs, and in operation prevents premature rupture of the second disc. The overall actuator assembly also includes a coupling unit connected to the body and having a connector presenting a fluid delivery port, with a third rupture disc normally in flow-blocking relationship across the port. The connector is designed for coupling with a valve-controlled source (preferably a solenoid valve-controlled source) of high pressure initiator fluid such as an inert gas (nitrogen or the like). The third rupture disc opens upon delivery of high pressure initiator fluid to the port, which in turn delivers a charge of initiator fluid into the interdisc zone. When this occurs, the first and second discs rupture in serial order to vent the suppression fluid. The perforate support for the second disc prevents rupture of that disc prior to rupture of the first disc, thereby assuring proper operation of the actuator assembly.

In preferred forms, each of the first and second discs is provided with at least one line of weakness in one face thereof. Such lines of weakness may be formed by any known technique such as scoring, milling or grinding. In one preferred embodiment, each of the discs has a pair of intersecting score lines formed in the outer face thereof. The outer or first disc is advantageously bulged to present a concavo-convex configuration, and the inner or second disc has a total of five openings therethrough, at the extreme ends of each score line and at the intersection of the score lines. The support is in the form of a pair of transversely oriented disc-engaging bars which are out of alignment with the second disc score lines. Alternatively, the bars may be in alignment with the second disc score lines.

The preferred connector is in the form of an elongated, tubular nipple mounted in the sidewall of the actuator body. The inboard end of the nipple supports the third rupture disc, whereas the opposed end thereof is threaded for connection to a conduit leading to the initiator fluid operating valve.

DESCRIPTION OF THE PREFERRED EMBODIMENT

Figure 1:
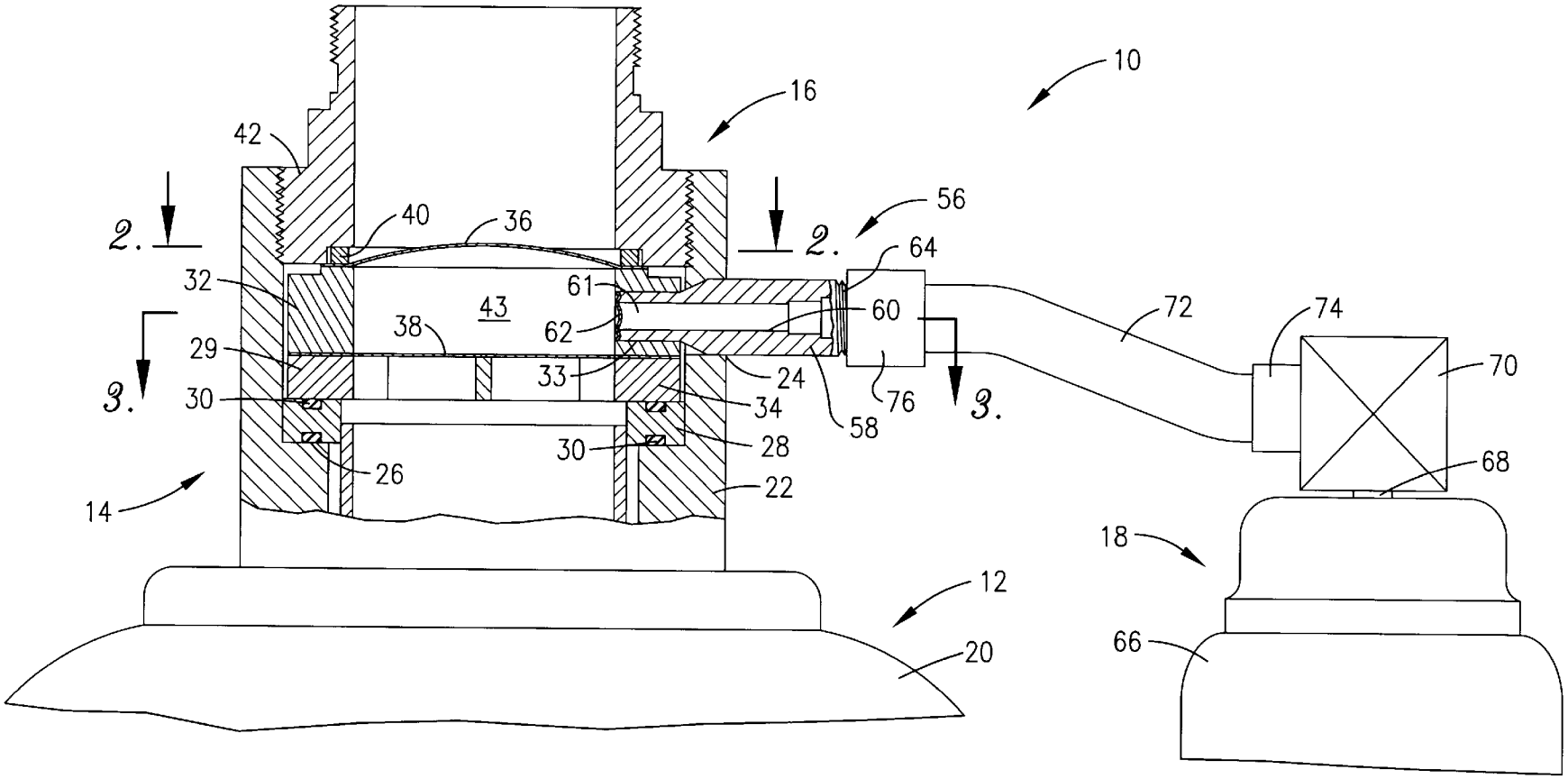
FIG. 1 is a fragmentary view in partial vertical section illustrating the outlet end of a hazard suppression fluid container with the actuator assembly of the invention operatively mounted to and closing the outlet end.
Figure 2:
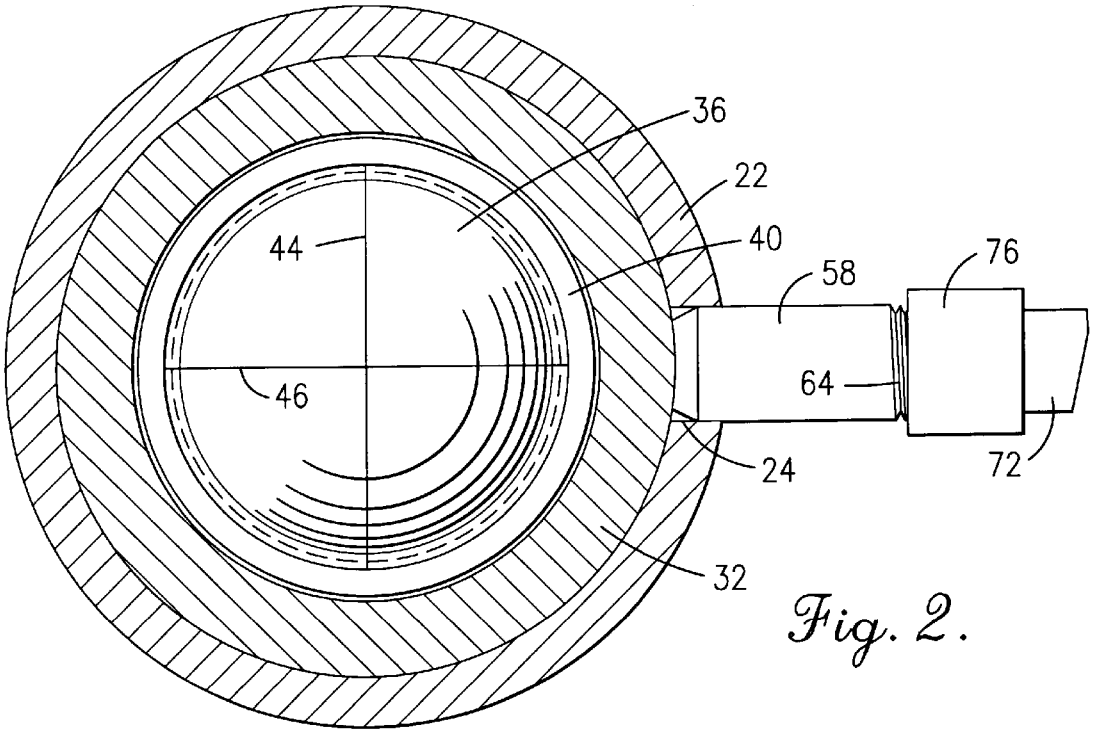
FIG. 2 is a sectional view taken along line 2—2 of FIG. 1 and illustrating the configuration of the preferred outer or first rupture disc of the actuator assembly.

Turning now to the drawings, and particularly FIG. 1, a hazard suppression apparatus 10 is illustrated. The apparatus 10 includes a pressurized container 12 containing a hazard suppression gas (typically a pressurized gas, pressurized to a liquid state) having an outlet 14, a multiple-disc actuator assembly 16 mounted across the outlet 14, and a valve-controlled container 18 (preferably a solenoid valve-controlled container) containing a charge of high pressure nitrogen which is connected to the assembly 16 as will be described.

In more detail, the container 12 is in the form of a thick-walled bottle 20 having an outlet 14 in the form of a tubular, internally threaded extension 22; the extension 22 is provided with an opening 24 through the sidewall thereof as shown. Also, the inner surface of the extension 22 presents a shoulder 26, the latter supporting a sealing ring 28 provided with upper and lower O-ring seals 30.

The actuator assembly 16 includes an annular actuator body 32 provided with an opening 33 in registry with the extension opening 24, as well as an annular support 34. The support rests upon sealing ring 28 as shown, whereas the body 32 is positioned atop the support. An outboard or first rupture disc 36 is located in engagement with the upper face of body 32 while an inboard or second rupture disc 38 is sandwiched between the lower face of body 32 and the upper face of support 34. The first and second discs 36, 38 are clamped in position by means of a clamping ring 40 positioned about the periphery of the outer face of disc 36, and a threaded coupler 42 engaging the opposite face of ring 40. Tightening of the coupler 42 thereby secures the body 32, support 34 and discs 36, 38 in place within the extension 22. First and second discs 36, 38, clamping ring 40, threaded coupler 42, body 32, and support 34 are all welded together in the preferred embodiment. It will be observed that an enclosed zone 43 is defined between the discs 36, 38.

The first disc 36 is preferably bulged to present a concavo-convex configuration and is provided with a pair of intersecting score lines 44, 46 which extend substantially the full diameter of the disc. The disc 36 is preferably constructed of a nickel alloy and has a thickness of from about 0.020–0.030 inches; the score lines normally have a depth of from about 0.010–0.015 inches.

The second disc 38 is likewise formed of nickel alloy but is of flat, non-bulged configuration. This disc has pair of intersecting score lines 48, 50 which are in alignment with the first disc score lines 44, 46. The second disc preferably has a thickness of from about 0.015–0.025 inches with a score line depth of from about 0.008–0.010 inches. Five small vent openings 52 are provided through the second disc 38. The openings 52 are located at the ends of the score lines 48, 50 closely adjacent the inner surface of body 32 and at the center of the disc at the point of intersection of the score lines.

Figure 3:
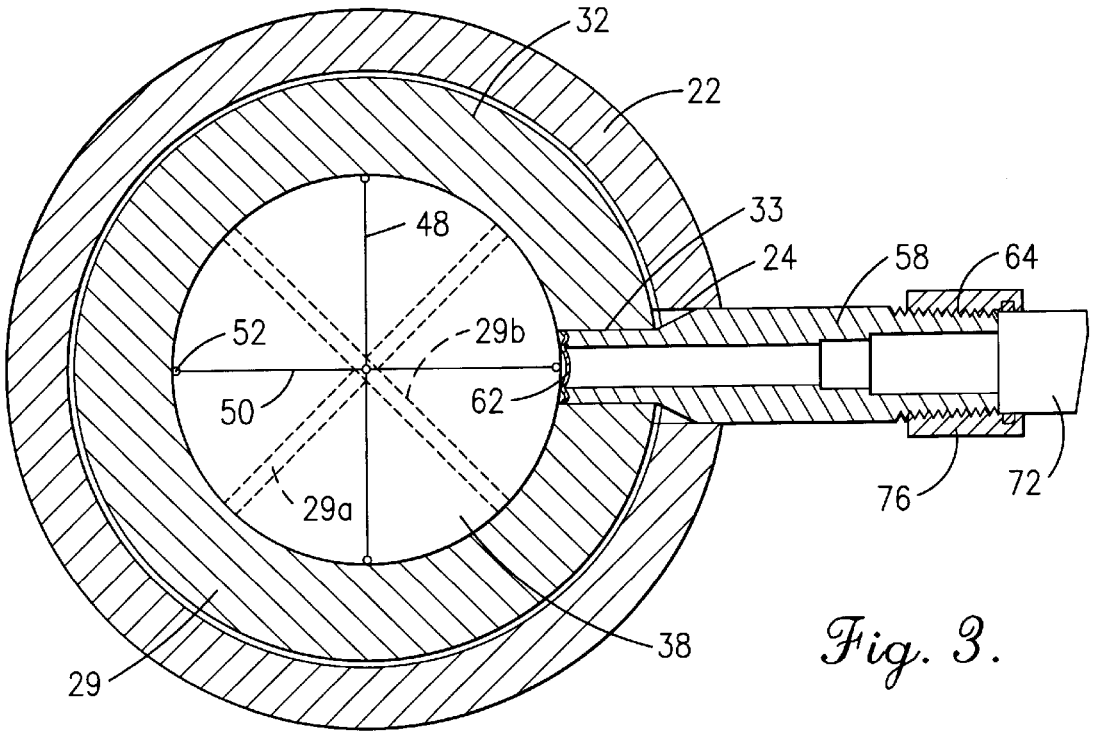
FIG. 3 is a sectional view taken along line 3—3 of FIG. 1 and depicting the configuration of the inner or second rupture disc of the actuator assembly and the connector nipple supporting the third rupture disc thereof, with the second disc support shown in phantom.

The support 28, operates as a flange for the dip tube and includes an outboard annular ring 29, as well as a pair of elongated, rectangular in cross-section, transversely oriented backing bars 29*a*, 29*b* affixed to the ring 29. As best seen in FIG. 3, the bars 29*a*, 29*b* are out of alignment with the score lines 48, 50. Alternatively, the bars may be in alignment with the score lines 48, 50.

The assembly 16 also includes a coupling unit 56 which is operatively received within the registered openings 24, 33 in the extension 22 and body 32 respectively. The unit 56 is in the form of an elongated, tubular connection nipple 58 having an inner bore 60 defining a delivery port 61, and a small, inboard third rupture disc 62 in flow-blocking relationship across the port 61 and in communication with the zone 43. The third disc 62 is again of concavo-convex configuration and is formed of nickel alloy. It has a thickness of from about 0.0025–0.0035 inches and may be scored if desired. The outer end of the nipple 58 is threaded as at 64.

The container 18 is also a thick-walled bottle 66 having a tubular outlet stem 68. A valve 70 is operatively coupled to the stem 68. Preferably, the valve will be a conventional solenoid valve. The valve 70 is adapted for connection with a hazard-detecting sensor (not shown) and is openable upon receiving a hazard signal from the sensor. An elongated tubular conduit 72, provided with endmost threaded connectors 74, 76, is used to connect the outlet of valve 70 with nipple 58.

Figure 4:
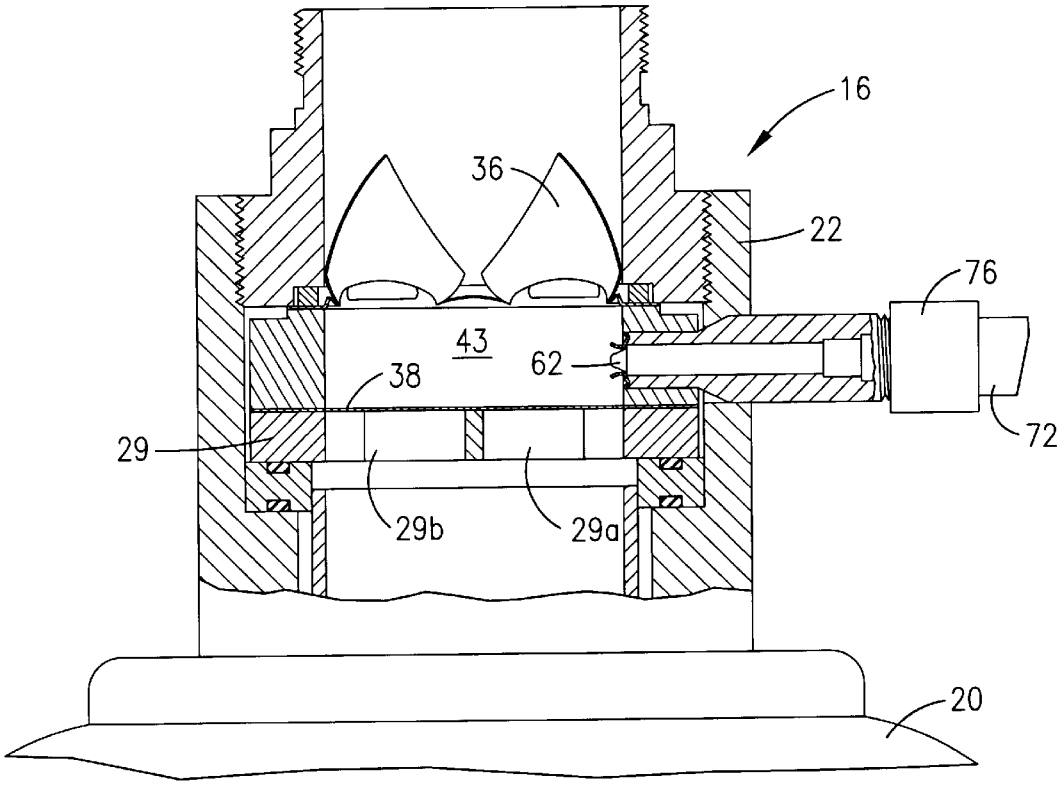
FIG. 4 is a fragmentary, partial sectional view similar to that of FIG. 1, and showing the actuator assembly during the initial stage of operation thereof where the third and first discs have ruptured.
Figure 5:
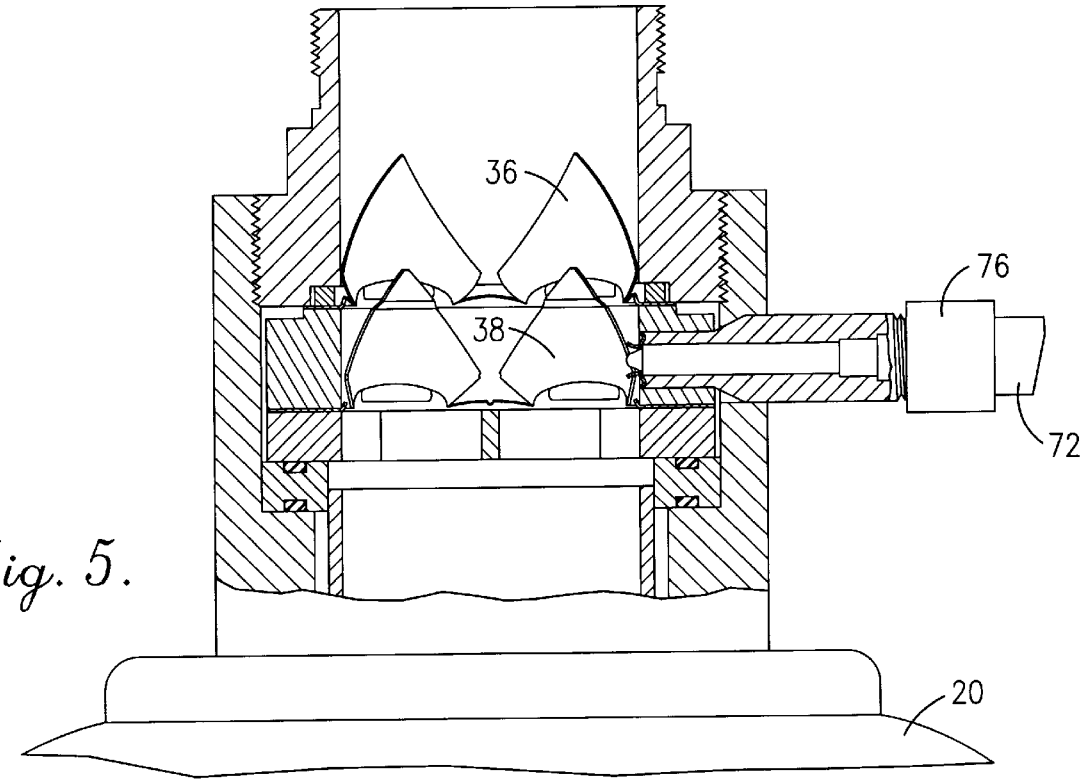
FIG. 5 is a fragmentary, partial sectional view similar to that of FIG. 4, and illustrating full actuation of the actuator assembly after rupturing of the second disc.

The operation of apparatus 10 is best understood from a consideration of FIGS. 4 and 5. That is, when a hazard is detected in an area protected by the apparatus 10, a signal is sent to valve 70 which quickly opens. This releases the high pressure nitrogen within container 18 which flows through conduit 72 and nipple bore 60. This high pressure charge rapidly ruptures the third disc 62, as depicted in FIG. 4, and consequently pressurizes the interdisc zone 43. When this occurs, the first disc 36 rapidly ruptures along the score lines 44, 46, again owing to the high pressure charge of inert gas delivered from container 18. During this initial stage of operation, rupturing of the second disc 38 is prevented because of the presence of the bar support 34; that is the bars 29*a*, 29*b* engage in the underside of the disc 38 prevent its initial rupture in the downward direction as viewed in FIG. 1.

After the first disc 36 ruptures as shown in FIG. 4, a significant pressure differential is created across the second disc 38. The suppressant within bottle 20 is normally maintained around 360 psi, whereas after the disc 36 ruptures the pressure on the opposite face of the disc 38 is normally atmospheric. This pressure differential causes rapid rupturing of the disc 38 along the score lines 48, 50. Of course, during this sequence the bars 29*a*, 29*b* of the support 34 do not come into play, i.e., the disc 38 ruptures outwardly and away from the bars as shown in FIG. 5.

Those skilled in the art will appreciate that the suppression apparatus 10 of the invention can be used in a variety of contexts. For example, any one of a number of conventional fire or explosion suppressants can be utilized, together with appropriate sensors. The actuator assemblies of the invention provide rapid, reliable operation in these systems. In like manner, many alterations are possible in the configuration of the rupture discs, disc support and other hardware.

We claim:

1. An actuator assembly adapted for connection to a container of pressurized hazard suppressant fluid having a venting outlet in order to permit rapid selective opening of the container permitting venting of the fluid from said outlet, said actuator assembly comprising:

an actuator body presenting a passageway therethrough and adapted for connection with said container outlet;

first and second spaced apart rupture discs operatively coupled with said body and located across said passageway and defining an enclosed zone therebetween, said first disc being imperforate and normally sealing said passageway, said second disc located adjacent said venting outlet and including at least one opening therethrough for establishing communication between said container and said zone;

a perforate support adjacent the face of said second disc remote from said zone; and a coupling unit operatively connected to said body and including a connector presenting a delivery port adapted for connection to a source of high pressure initiator fluid, and a third rupture disc normally in flow-blocking relationship across said delivery port, said third rupture disc rupturable upon delivery of said high pressure initiator fluid to said port in order to deliver said initiator fluid into said zone, said first and second rupture discs configured for, upon said delivery of said initiator fluid into said zone, initial rupturing of said first disc and subsequent rupturing of said second disc, said support preventing rupturing of said second disc prior to rupturing of said first disc.

2. The actuator assembly of claim 1, said second disc including at least one line of weakness in one face thereof, said support including a pair of transverse bars adjacent said second disc.

3. The actuator assembly of claim 2, said second disc having a pair of transverse, intersecting score lines on the face thereof remote from said support, said support bars being out of alignment with said score lines.

4. The actuator assembly of claim 1, said first disc including at least one line of weakness in one face thereof.

5. The actuator assembly of claim 4, said first disc including a pair of transverse, intersecting score lines of the face thereof remote from said zone, said first disc being bulged to present a concavo-convex configuration.

6. The actuator assembly of claim 1, said body being annular and presenting a sidewall, said coupling unit extending through said sidewall.

7. The actuator assembly of claim 6, said connector comprising an elongated, tubular nipple, said third rupture disc being coupled to one end of said nipple.

8. Hazard suppression apparatus comprising:

a container of pressurized hazard suppressant fluid having a venting outlet;

an actuator assembly including an actuator body presenting a passageway therethrough and connected with said container outlet;

first and second spaced apart rupture discs operatively coupled with said body and located across said passageway and defining an enclosed zone therebetween, said first disc being imperforate and normally sealing said passageway, said second disc located adjacent said venting outlet and including at least one opening therethrough for establishing communication between said container and said zone;

a perforate support adjacent the face of said second disc remote from said zone; and a coupling unit operatively connected to said body and including a connector presenting a delivery port and a third rupture disc normally in flow-blocking relationship across said delivery port;

a source of high pressure initiator fluid operatively coupled with said connector; and a selectively openable valve between said source of high pressure initiator fluid and said third disc, said third rupture disc rupturable upon opening of said valve and delivery of said high pressure initiator fluid to said port in order to deliver said initiator fluid into said zone, said first and second rupture discs configured for, upon said delivery of said initiator fluid into said zone, initial rupturing of said first disc and subsequent rupturing of said second disc, said support preventing rupturing of said second disc prior to rupturing of said first disc.

9. The hazard suppression apparatus of claim 8, said second disc including at least one line of weakness in one face thereof, said support including a pair of transverse bars adjacent said second disc.

10. The hazard suppression apparatus of claim 9, said second disc having a pair of transverse, intersecting score lines on the face thereof remote from said support, said support bars being out of alignment with said score lines.

11. The hazard suppression apparatus of claim 8, said first disc including at least one line of weakness in one face thereof.

12. The hazard suppression apparatus of claim 11, said first disc including a pair of transverse, intersecting score lines of the face thereof remote from said zone, said first disc being bulged to present a concavo-convex configuration.

13. The hazard suppression apparatus of claim 8, said body being annular and presenting a sidewall, said coupling unit extending through said sidewall.

14. The hazard suppression apparatus of claim 13, said connector comprising an elongated, tubular nipple, said third rupture disc being coupled to one end of said nipple.

15. The hazard suppression apparatus of claim 8, said valve being a solenoid valve adapted for connection with a hazard-detecting sensor and openable upon receiving a hazard signal from said sensor.

16. The hazard suppression apparatus of claim 8, said source of initiator fluid comprising a container containing pressurized inert gas.

* * * * *